US007073852B1

(12) United States Patent
Zheng

(10) Patent No.: US 7,073,852 B1
(45) Date of Patent: Jul. 11, 2006

(54) COLLAPSIBLE CHAIR WITH TENSIONED SEAT

(76) Inventor: Edward Zheng, 876 Everset Dr., Chino Hills, CA (US) 91709

( * ) Notice: Subject to any disclaimer, the term of this patent is extended or adjusted under 35 U.S.C. 154(b) by 0 days.

(21) Appl. No.: 10/416,078

(22) PCT Filed: Nov. 7, 2000

(86) PCT No.: PCT/US00/41981

§ 371 (c)(1),
(2), (4) Date: Oct. 20, 2003

(87) PCT Pub. No.: WO02/38010

PCT Pub. Date: May 16, 2002

(51) Int. Cl.
*A47C 4/00* (2006.01)

(52) U.S. Cl. ..... 297/16.2; 297/55

(58) Field of Classification Search ..... 297/16.2, 297/45, 55

See application file for complete search history.

(56) References Cited

U.S. PATENT DOCUMENTS

| | | | | | |
|---|---|---|---|---|---|
| 1,730,916 | A | * | 10/1929 | Cable | 297/58 |
| 2,381,574 | A | * | 8/1945 | Clarin | 297/58 |
| 4,014,591 | A | * | 3/1977 | Gittings | 297/55 |
| 4,118,065 | A | * | 10/1978 | Watkins | 297/45 |
| 5,288,098 | A | * | 2/1994 | Shamie | 297/42 |
| 5,622,376 | A | * | 4/1997 | Shamie | 297/16.2 |
| 5,897,161 | A | * | 4/1999 | Karg | 297/16.2 |

FOREIGN PATENT DOCUMENTS

| | | | | |
|---|---|---|---|---|
| FR | 1110223 | * | 10/1954 | 297/55 |

* cited by examiner

*Primary Examiner*—Peter R. Brown
(74) *Attorney, Agent, or Firm*—Rutan & Tucker, LLP

(57) ABSTRACT

A collapsible chair (10) has a first (110) and second (112) front leg, a rear leg (120), a seat support rod (130), and a backrest is attached to the front legs. The legs and the seat support rod are coupled via cross braces (140, 150) such that the seat support rod pivots in one direction while the rear leg pivots in the opposite direction when the front legs are approximated to each other. Preferred chairs comprise a seat that is tensioned when the front legs move apart, and the seat remains substantially tensioned when the seat supports a person.

10 Claims, 2 Drawing Sheets

COLLAPSIBLE CHAIR WITH TENSIONED SEAT

FIELD OF THE INVENTION

The field of the invention is collapsible furniture.

BACKGROUND OF THE INVENTION

Folding chairs are relatively popular, because they can be stored with considerably reduced space requirements when compared to non-folding chairs. Nevertheless, folding chairs still require relatively large space, since the dimension of the folding chair is generally reduced only along one space coordinate (e.g., reduced length). To further reduce the space requirement, collapsible chairs have been developed, in which further size reduction is achieved by folding the chair along at least two space coordinates (e.g., length and width). Various collapsing chairs are known in the art.

For example, Cook et al. describes in U.S. Pat. No. 5,921,621 a collapsible chair with a foldable backrest, in which the chair has four legs that support the corners of a flexible square seat. The legs are movably attached to each other at about their respective midpoints, and the seat is collapsed in width and depth by turning the legs around the midpoint. While Cooks chair is relatively easy to unfold and collapse, Cooks chair provides relatively little stability and is prone to tipping over.

Improved stability can be achieved by including slidable cross bars between the legs as described in U.S. Pat. No. 6,082,813 to Chen and U.S. Pat. No. 5,984,406 to Lee. Chen's chair advantageously collapses to a relatively compact form. However, the position of the back support is limited to a vertical position, which may not be comfortable over a prolonged period. On the other hand, Lee's chair provides an angled backrest, although it lacks a seat support entirely.

In addition to the problems of the collapsible chairs mentioned above, all or almost all of the known collapsible chairs suffer from a common disadvantage in that the seat will loose tension once the seat supports the weight of a person. Moreover, where known chairs are collapsible in a single motion, such chairs do typically fail to provide a seat support rod onto which the seat can be tensioned. Alternatively, where known chairs have a pair of seat support rods, such chairs generally require at least two folding motions (e.g., one motion in which the seat is folded upwards followed by one motion in which the seat is folded in a side-to-side movement). Therefore, there is a need to provide improved methods and apparatus for collapsible chairs.

SUMMARY OF THE INVENTION

The present invention is directed to a collapsible chair that can be collapsed in a single motion, wherein the chair includes a tensioned seat coupled to a pair of seat support rods. In particular, the collapsible chair has a pair of front legs, rear legs, and a pair of seat support rods wherein a backrest is coupled to the front legs, and a tensioned seat is coupled to the seat support rods. The front legs, the rear legs, and the seat support rods are coupled in a manner such that the chair collapses in a single movement in which the front legs approximate each other when the rear legs and the seat support rods pivot towards the front legs.

In one aspect of the inventive subject matter, contemplated chairs include a first front leg and a second front leg, a rear leg, a seat support rod, and a backrest attached to the front legs. A first cross brace is rotatably coupled to the rear leg and slidably coupled to the first front leg, and a second cross brace is rotatably coupled to the second front leg and slidably coupled to the seat support rod. The seat support rod in contemplated chairs pivot in a first direction relative to the first front leg and the rear leg pivots in a direction opposite to the first direction when the first and second front legs approximate each other.

In a preferred aspect of the inventive subject matter, the chair has a second seat support rod, and a seat is attached to the seat support rods, wherein the seat is tensioned when the first and the second front legs move apart, and wherein the seat remains substantially tensioned when the seat supports a person.

In another aspect of the inventive subject matter, the legs and seat support are manufactured from a metal, preferably aluminum, and the seat and backrest may be coupled together and are fabricated from a weather resistant material, preferably a synthetic polymer, and more preferably from Nylon.

In a further aspect of the inventive subject matter, a method of imparting collapsibility into a chair comprise one step in which a first and a second front leg, a first and a second seat support rod, and a first and a second rear leg are provided. In a further step, the first and the second front legs are coupled with a first cross brace, wherein the first cross brace is rotatably attached to the first front leg and slidably attached to the second front leg, and the first front leg and the second seat support rod are coupled with a second cross brace, wherein the second cross brace is rotatably attached to the first front leg and slidably attached to the second seat support rod. In a further step, the first front leg is rotatably coupled to the first rear leg and the first seat support rod, while the first seat support rod is slidably coupled to the first rear leg.

Various objects, features, aspects and advantages of the present invention will become more apparent from the following detailed description of preferred embodiments of the invention, along with the accompanying drawings, in which like numerals represent like components.

DETAILED DESCRIPTION

It is generally contemplated that a collapsible chair includes a tensioned seat coupled to a pair of seat support rods, and the chair can be collapsed in a single motion. Contemplated chairs have a pair of front legs, rear legs, and a pair of seat support rods wherein a backrest is coupled to the front legs, and a tensioned seat is coupled to the seat support rods. The front legs, the rear legs, and the seat support rods are coupled in a manner such that the chair collapses in a single movement in which the front legs approximate each other when the rear legs and the seat support rods pivot towards the front legs.

Figure 1:
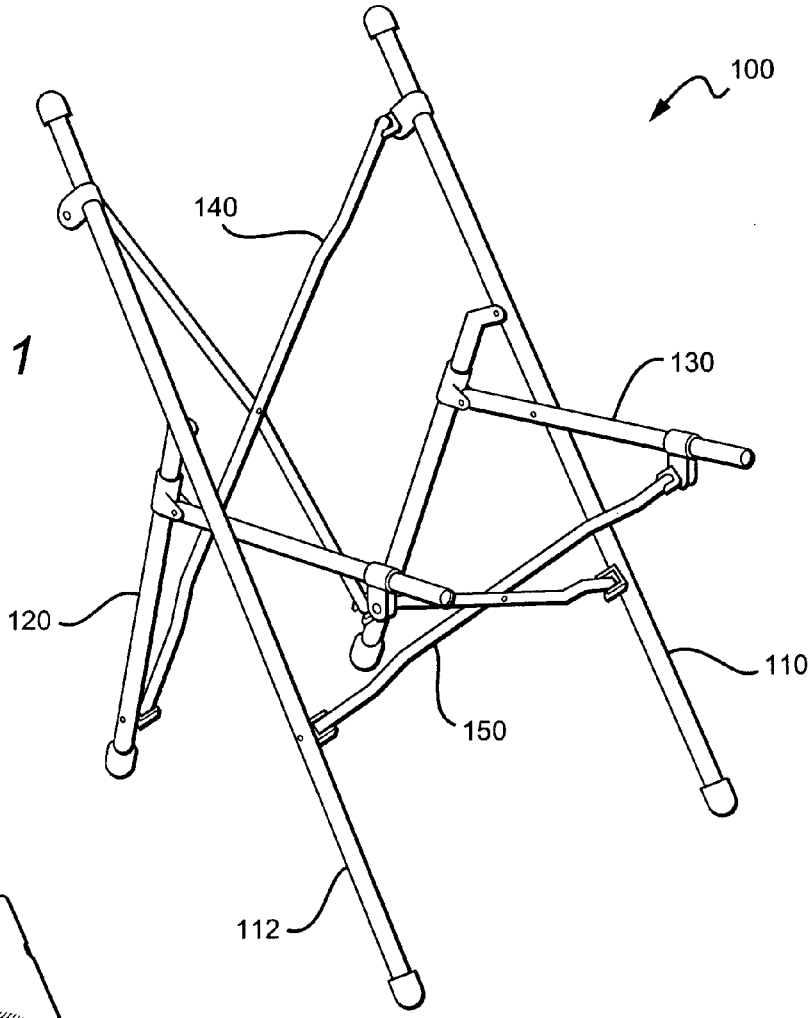
FIG. 1 is a perspective view of a collapsible chair without seat and backrest.
Figure 2:
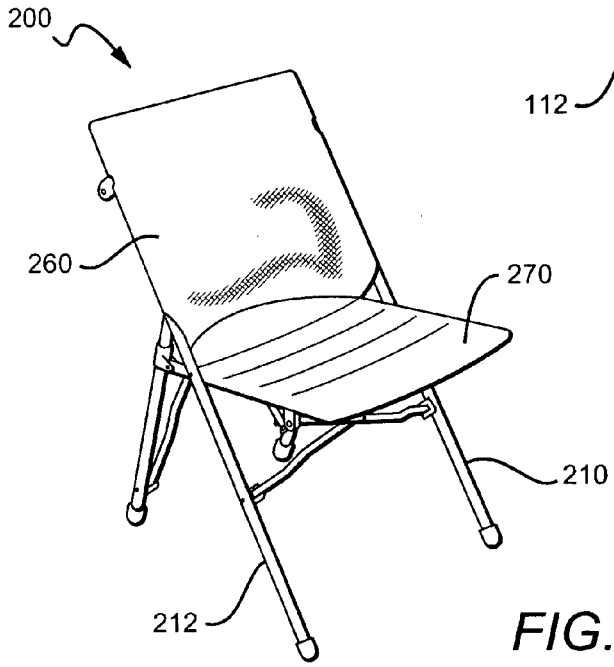
FIG. 2 is a perspective view of the collapsible chair of FIG. 1 with attached seat and backrest.

In FIG. 1, a collapsible chair 100 has a first front leg 110 and a second front leg 112, a rear leg 120, a seat support rod 130, and a backrest (not shown in FIG. 1, see FIG. 2). A first cross brace 140 is rotatably coupled to the rear leg and slidably coupled to the first front leg 110, and a second cross brace 150 is rotatably coupled to the second front leg 112 and slidably coupled to the seat support rod 130; The backrest is attached to the first and second front legs 110 and 112, wherein the seat support rod 130 pivots in a first direction relative to the first front leg 110 and the rear leg 120 pivots in a direction opposite to the first direction when the first and second front legs 110 and 112 approximate each other.

Figure 3:
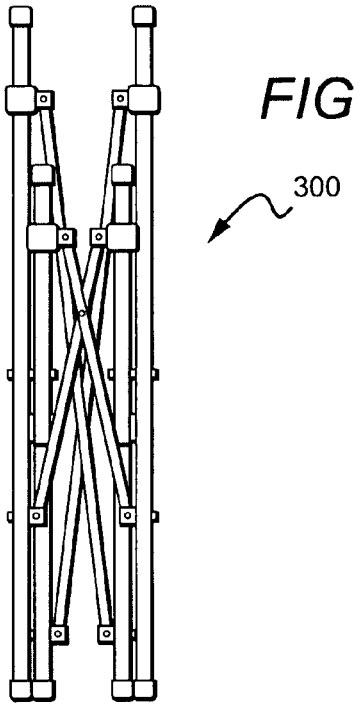
FIG. 3 is a perspective view of the collapsible chair of FIG. 1 in collapsed configuration.
Figure 4:
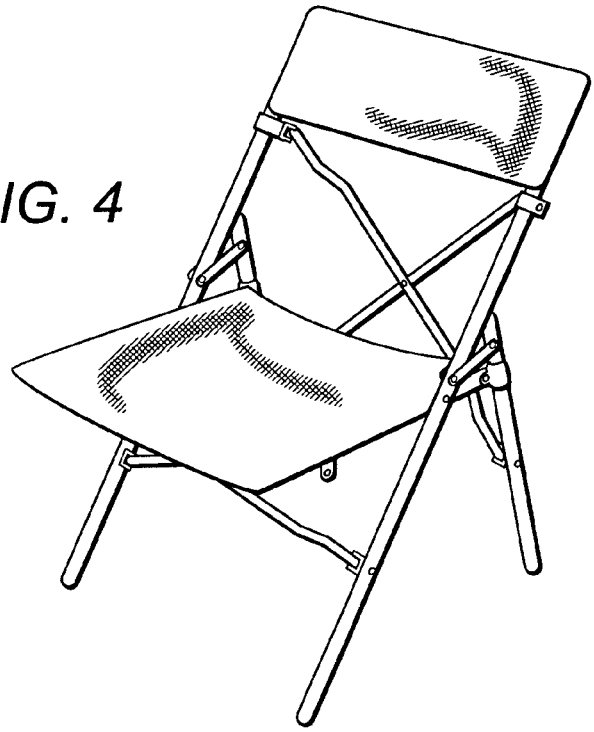
FIG. 4 is a perspective view of another collapsible chair with tensioned seat and backrest.
Figure 5:
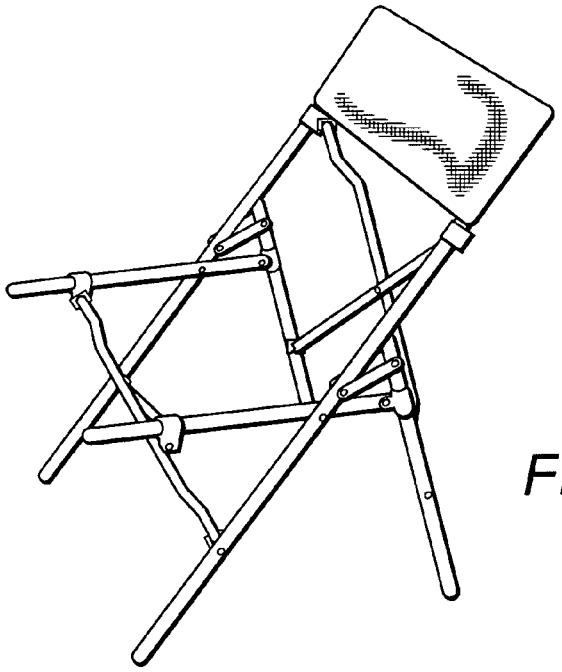
FIG. 5 is a perspective view of the collapsible chair of FIG. 4 without tensioned seat and backrest.

In FIG. 2, the collapsible chair 200 further has a backrest 260 attached to the first and second front legs 210 and 212, and a seat 270 is attached to the seat support rods (not visible in FIG. 2, see FIG. 1). FIG. 3 depicts the collapsible chair 300 of FIG. 1 in a collapsed configuration. An alternative embodiment of the inventive subject matter is depicted in FIG. 4, in which a collapsible chair is depicted with a tensioned seat. In FIG. 5, the chair of FIG. 4 is shown without the tensioned seat.

It is contemplated that the seat and the backrest are fabricated from a weather resistant material, preferably a woven synthetic polymer (e.g., Nylon) and is uniformly colored (e.g., blue). Particularly preferred seats have a width of about 21 inches and an overall length of about 24 inches. However, it should be appreciated that various alternative materials, colors, and sizes are also appropriate.

For example, alternative materials may include natural and synthetic fabrics and all reasonable combinations thereof. Contemplated materials may further be woven or non-woven and particularly contemplated materials include polyester, polyvinyl chloride, cotton, hemp, and wool. With respect to the color, it is contemplated that suitable colors need not be restricted to uniform color, but appropriate colors may also include color patterns, prints, or no color at all. While it is generally preferred that the chair according to the inventive subject matter is sized and dimensioned to fit an average adult person, it is also contemplated that appropriate chairs may also accommodate a child, a smaller- or larger-than-average adult, or more than a single person. Therefore, alternative chairs may have dimensions that are wider than 21 inches, and suitable widths include 21–24, 24–30, and 30–40 inches, and wider, but also 18–21, 14–18, and 8–14 inches, and narrower. Likewise, the length of appropriate seats may vary between 20–42, 15–10, and 12–15 inches and less, but also between 24–27, 27–30, and more. It should further be appreciated that contemplated seats may also be tapered from the front end to the back end, or vice versa.

With respect to the backrest it is contemplated that the backrest is fabricated from the same material as the seat, and that the backrest is removably or permanently coupled to the seat (e.g., sewed, coupled with a zipper, etc.) Thus, it is preferred that the backrest has a width of about 21 inches. A preferred height of the backrest is about 18 inches. With respect to the material and color, it is contemplated that the same considerations as for the seat apply. It is further contemplated that the width and height of suitable backrests may vary, and that width and height will depend among other things on the person's size and the number of persons to be seated in the chair. Thus, alternative backrests may have a width between 18–12 inches and less, but also between 18–22 and more. Similarly, contemplated backrests may have a height between 12–18 inches and less, but also between 18–25 inches and more.

It is generally contemplated that the seat and the backrest may be coupled to the legs and seat support rods in numerous ways, including temporary and permanent coupling. Temporary couplings include hook-and-loop type fasteners, snaps, buckles, slidable elements (e.g., a pouch slidably coupled to a post, a ring slidably coupled to a rod, etc.), and threadbly securable elements (e.g., laces threaded through rings). Permanent couplings include sewed or glued elements. For example, the backrest may permanently coupled to the chair via a rivet. On the other hand, the front end of the seat may be temporarily coupled to the front legs via ring-shaped openings slided over the top ends of the front legs. It is further, particularly preferred that the seat and the backrest are coupled together.

It should further be appreciated that the attachment of the seat and/or the backrest to the chair may be directly or indirectly attached. As used herein, the term "direct" attachment means that the seat and/or the backrest are in immediate contact with the supporting structure, whereas the term "indirect" means that an additional element connects the seat and/or backrest with the supporting structure. For example, the seat may be directly attached to the seat support rods via a slidable pouch. Alternatively, the seat may be indirectly coupled to the seat support rods via a ring-shaped opening in the seat that slidably engages with the rods.

With respect to the legs, seat support rods, and cross braces of contemplated chairs, it should be appreciated that all of these elements may be manufactured from various materials, including metals, metal alloys, natural and synthetic polymers, and any reasonable combination thereof. However, it is preferred that the legs, seat support rods, and cross braces are manufactured from black anodized aluminum tubing with a wall strength of about 1/32 inch and an outer diameter of approximately ½ inch. Preferred alternative materials include stainless steel, fiberglass, and wood.

Where one of the legs, seat support rods, and cross braces is pivotably coupled to another one of the legs, seat support rods, and cross braces, it is generally contemplated that all known manners of coupling rotatably are suitable for use in conjunction with the teachings presented herein. For example, appropriate manners of coupling rotatably include coupling of two elements via a common axis, coupling via a hinge wherein the hinge may or may not have a slidable connection to another element, coupling via a ball bearing, etc. Similarly, where one of the legs, seat support rods, and cross braces is slidably coupled to another one of the legs, seat support rods, and cross braces, all known slidable couplings are contemplated to be appropriate, and include a sliding sleeve, slide rails, guiding rings, etc.

In a preferred aspect, a collapsible chair has two front legs, two rear legs, and two seat support rods, wherein a first pair of cross braces couples the front legs to the seat support rods, and a second pair of cross braces couples the front legs to the rear legs. It is particularly preferred, that all of the front legs, rear legs and seat support rods are coupled through the cross braces in a manner that allows collapsing the chair in a single movement, i.e., that the front legs approximate each other and the front end of the seat support rods rotates towards one end of the front legs, when the rear legs pivot towards the other end of the front legs. In preferred configurations, the seat support rod pivots upwardly and the back leg pivots downwardly relative to the first front leg, when the chair is unfolded in an extended configuration. As viewed from another perspective, it is preferred that the seat and backrest fold when the front legs approximate.

Thus, a method of imparting collapsibility into a chair has one step in which a first and a second front leg, a first and a second seat support rod, and a first and a second rear leg are provided. In another step, the first and the second front leg are coupled with a first cross brace, wherein the first cross brace is rotatably attached to the first front leg and slidably attached to the second front leg. The first front leg is coupled with the second seat support rod with a second cross brace, wherein the second cross brace is rotatably attached to the first front leg and slidably attached to the second seat support rod. In a further step, the first front leg is rotatably coupled to the first rear leg and the first seat support rod, and in yet another step the first seat support rod is slidably coupled to the first rear leg.

It should be recognized that such preferred coupling may be realized in various configurations. In an exemplary configuration of preferred chairs, the front leg on one side of the chair is coupled to the seat support rod on the other side of the chair via a cross brace, wherein the cross brace is on one end rotatably coupled to the front leg, and on the other end rotatably and slidably coupled to the seat support rod. The front leg on the other side of the chair is coupled to the seat support rod on the opposite side of the chair via a cross brace, wherein the cross brace is on one end rotatably coupled to the front leg, and on the other end rotatably and slidably coupled to the seat support rod. Both of the front legs are rotatably coupled to the respective seat support rods, wherein the coupling point to the front leg is located in about the middle of the length of the front leg, and wherein the coupling point to the seat support rod is located in about a third of the length of the seat support rod. Each of the seat support rods is further rotatably and slidably coupled to the respective rear leg, wherein the point of coupling is approximately at the rear end (relative to the seat) of the seat support rod. Both of the rear legs are rotatably coupled near their upper ends to the front leg, wherein the point of coupling is above the coupling point of the front leg to the seat support rod. Another set of cross braces (e.g., two cross braces) couples the upper end of the front legs with the lower end of the rear legs, wherein the coupling between the cross brace and the rear leg is rotatable, and the coupling between the cross brace and the rear leg is rotatable and slidable.

However, it should be appreciated that in alternative aspects of the inventive subject matter the number of legs, and/or seat supports may vary considerably. For example, where the chair is sized and dimensioned to accommodate more than one person, three, four, or more legs, and/or seat supports may be included. On the other hand, where stability of the seat is particularly desirable, three or more seat support rods may be included in a chair with two front legs and two rear legs. Likewise, the number of cross braces may vary, and while some chairs may have only one pair of cross braces, other chairs may include three, four, or more cross braces.

Furthermore, it should be appreciated that the coupling may very depending on the particular configuration of contemplated chairs. For example it is contemplated that all of the couplings may be rotatable and slidable. Alternatively, where slidable couplings are less desirable, alternative couplings may be employed and suitable couplings especially include temporary couplings such as snap connectors, connectors that are secured with a pin or other removable element, etc. In still further alternative aspects of the inventive subject matter, the coupling may be done via an intermediate rod, that rotatably couples two elements together (e.g., the intermediate rod that couples the front leg to the rear leg in FIG. 2).

It should be especially appreciated that in contemplated configurations of collapsible chairs, the seat is tensioned when the first and the second front legs move apart, and that the seat remains substantially tensioned when the seat supports a person. The term "tensioned seat" means that the seat is substantially level when the chair is in the open configuration, wherein the term "substantially level" means that the vertical distance between any point of the seat and the seat support rod is no more than one 0.75 inch, more preferably no more than 0.5 inch, and most preferably no more than 0.25 inch. The term "open configuration" refers to the configuration of the collapsible chair in which the front legs have a maximum distance from each other when the chair is opened using reasonable force (i.e. without damaging the mechanical structure). The term "remains substantially tensioned" means that the vertical distance between the lowest point of the seat and the seat support rod increases no more than one inch, preferably no more than 0.75 inch, more preferably no more than 0.5 inch, and most preferably no more than 0.25 inch. Thus, it should be recognized that the tension of the seat is predominantly determined by the firmness of the material of the seat.

While not whishing to be bound by a particular theory, it is contemplated that the tension in the seat remains substantially tensioned due to mechanically coupling an approximating movement of the seat support rods with a simultaneous movement of at least one of the rear legs relative to the front leg and a movement of the front legs relative to each other. Viewed from another perspective, it should be recognized that while all or almost all of the prior art chairs with a seat support rod require at least two separate folding operations to collapse the chair, contemplated collapsing chairs are folded in a single movement (comparably to the collapsing of an umbrella). Moreover, it should be recognized that contemplated modes of coupling the front leg with the rear leg and the seat support rod prevent loss of tension of the seat when a person is supported by the chair.

Thus, specific embodiments and applications of collapsible chairs have been disclosed. It should be apparent, however, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

What is claimed is:

1. A collapsible chair, comprising:

a first front leg and a second front leg, a pair of rear legs, a pair of seat support rods, and a backrest;

a first cross brace rotatably coupled to the pair of rear legs and rotatably coupled to the first and second front legs, and a second cross brace rotatably coupled to the first and second front legs and rotatably coupled to the pair of seat support rods;

wherein the pair of seat support rods are rotatably and slidably coupled to the rear legs such that the rear legs approximate the front legs as the front legs approximate each other; and a backrest attached to the first and second front legs.

2. The collapsible chair of claim 1 wherein the seat is tensioned when the first and the second front legs move apart, and wherein the seat remains substantially tensioned when the seat supports a person.

3. The collapsible chair of claim 2 wherein the seat is fabricated from a weather resistant material.

4. The collapsible chair of claim 2 wherein the seat is removably attached to the pair of seat support rods.

5. The collapsible chair of claim 2 wherein the seat is coupled to the backrest.

6. The collapsible chair of claim 1 wherein the backrest is removably attached to the first and second front legs.

7. The collapsible chair of claim 1 wherein the seat support rod pivots upwardly and the back leg pivots downwardly relative to the first front leg, when the chair is unfolded in an extended configuration.

8. A method of imparting collapsibility into a chair, comprising:

providing a first front leg and a second front leg, a pair of rear legs, a pair of seat support rods, and a backrest;

rotatably coupling a first cross brace to the pair of rear legs and further rotatably coupling the first cross brace to the first and second front legs;

rotatably coupling a second second cross brace to the first and second front legs and further rotatably coupling the second cross brace to the pair of sear support rods;

wherein the pair of seat support rods are rotatably and slidably coupled to the rear legs such that the rear legs approximate the front legs as the front legs approximate each other; and coupling a backrest to the first and second front legs.

9. The method of claim 8 further comprising a step of coupling a set to the seat support rods.

10. The method of claim 9 wherein the seat is contiguous with the backrest.

* * * * *